US008062082B1

(12) United States Patent
Anderson et al.

(10) Patent No.: US 8,062,082 B1
(45) Date of Patent: Nov. 22, 2011

(54) MARINE DRIVE UNIT WITH STAGED ENERGY ABSORPTION CAPABILITY

(75) Inventors: Arden A. Anderson, Fond du Lac, WI (US); Michael P. Mihelich, Fond du Lac, WI (US); Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 278 days.

(21) Appl. No.: 12/480,136

(22) Filed: Jun. 8, 2009

(51) Int. Cl.
*B63H 20/08* (2006.01)

(52) U.S. Cl. ..... 440/56; 440/71

(58) Field of Classification Search ..... 440/56, 440/71, 76, 78
See application file for complete search history.

(56) References Cited

U.S. PATENT DOCUMENTS

| | | | | |
|---|---|---|---|---|
| 1,943,288 | A | 1/1934 | Chandler et al. | |
| 2,093,454 | A | 9/1937 | Kistler | |
| 2,681,029 | A | 6/1954 | Canazzi | |
| 2,917,019 | A | 12/1959 | Krueger | |
| 3,151,597 | A | 10/1964 | Larsen | |
| 3,903,827 | A | 9/1975 | Marcil | |
| 5,007,868 | A | 4/1991 | Fry | |
| 5,018,997 | A | 5/1991 | Guptill | |
| 5,277,632 | A | 1/1994 | Davis | |
| 5,361,715 | A | 11/1994 | Kiedaisch et al. | |
| 6,315,623 | B1 | 11/2001 | Hedlund | |
| 6,966,806 | B1 | 11/2005 | Bruestle et al. | |
| 7,435,147 | B1 | 10/2008 | Eichinger | |
| 7,690,959 | B1 * | 4/2010 | Szilagyi et al. | 440/52 |

* cited by examiner

*Primary Examiner* — Lars A Olson
(74) *Attorney, Agent, or Firm* — William D. Lanyi

(57) ABSTRACT

A marine propulsion drive unit is provided with two energy absorbing structures, one comprising a crushable or deformable nose cone or leading edge of a driveshaft housing and the other comprising a frangible interface that allows the drive unit to separate from the hull of a marine vessel. The crushable or deformable nose cone is configured to absorb energy at relatively low impact velocities with submerged structures and the frangible interface is configured to absorb energy and then detach from the hull of the marine vessel at higher impact velocities.

22 Claims, 8 Drawing Sheets

MARINE DRIVE UNIT WITH STAGED ENERGY ABSORPTION CAPABILITY

BACKGROUND OF THE INVENTION

1. Field of the Invention

The present invention is generally related to a marine drive unit which is able to absorb energy during an impact situation and, more particularly, to a marine propulsion system which provides at least two energy absorption portions which are cooperatively configured to experience an acceptable amount of damage during low speed collisions and react to higher speed collisions with a separation of the propulsion unit from the hull of a marine vessel without seriously breeching the hull.

2. Description of the Related Art

Many different types of marine propulsion systems are well known to those skilled in the art. Some of these propulsion systems are provided with shock absorbing capability through the use of hydraulic or pneumatic cylinders. Typically, this technique is used in conjunction with outboard motors or sterndrive systems. However, some other types of marine propulsion devices utilize techniques that absorb energy in other ways. These other techniques can involve the use of energy absorbing devices or breakaway systems.

U.S. Pat. No. 1,943,288, which issued to Chandler et al. on Jan. 16, 1934, describes an outboard propeller and rudder mounting device. The primary object of the system is to provide a highly efficient, practical, and novel design of a drive unit that is adapted for connection with the driveshaft of a motor or engine disposed within the hull of a boat. A further object of the device is to provide a drive unit with a swingable propeller mounting permitting a laterally upward movement of the propeller while running, thus permitting the propeller to function in relatively shallow water in conjunction with a rudder support and a rudder which is mounted and adapted for control adjustment independent of the propeller mounting.

U.S. Pat. No. 2,093,454, which issued to Kistler on Sep. 21, 1937, describes a method of producing an aerogel material. Whenever a colloidal solution is precipitated, the product formed is usually defined as a gel. It is distinct from the precipitates from crystalloidal solutions by containing large quantities of the solvent in a soft gelatinous mass, usually microscopically heterogeneous and presenting some rigidity.

U.S. Pat. No. 2,681,029, which issued to Canazzi on Jun. 15, 1954, describes a propulsion drive unit for boats. It relates to improvements in boat drives wherein a propulsion unit of the drive is secured to the outboard side of a boat and is operably connected to a motor and to operating controls within the boat. It provides a small, compact, quiet and efficient reversible and steerable propulsion drive unit for boats to provide an attractive appearing housing which encases a drive mechanism, a cooling system for the drive mechanism and reversing and steering mechanism so that by forming a single large installation hole in a boat the drive unit may be readily installed and operably connected to a motor, to cooling and exhaust conduits of the motor, and to steering and reversing controls in the boat.

U.S. Pat. No. 2,917,019, which issued to Krueger on Dec. 15, 1959, describes a propeller housing attachment. It provides an improved insertable motor mounting structure for a boat in combination with the protection of a motor boat propeller and its operating mechanism. It is concerned with an improved insertable reinforcing structure for a motor mounting and the protection, removal and replacement of a boat propeller in combination with an automatic ignition cutoff when the propeller housing and its associated driveshaft are disengaged from the main driveshaft housing and its associated driveshaft. In the operation of outboard motor craft using a propeller drive there is usually provided at some point of the drive a shear pin or key which is automatically broken when the propeller hits a snag or is stopped suddenly by some obstructing force. This shear pin must be replaced by dismantling the structure and replacing the broken shear pin. This dismantling of a simple outboard motor is usually not difficult, if tools are available, as the motor can be dismounted or the propeller tipped out of the water within reach of the hands. However, with larger permanently installed motors, where the propeller housing and its associated drive are a permanent attachment, the replacement of the shear pin or repair of a damaged propeller is more difficult and usually requires breeching of the craft for necessary repairs.

U.S. Pat. No. 3,151,597, which issued to Larsen on Oct. 6, 1964, describes an impact absorbing means for a marine propulsion device. It relates to structures which carry a propeller which are normally submerged during operation and which are accordingly subject to impact against a submerged obstacle. The striking of submerged obstacles results in impact loading of the unitary assembly and a change in the direction of momentum of the unitary assembly evidenced by the upward swinging of the unitary assembly about its horizontal pivotal mounting. The invention involves the provision of bumper means including a body of resilient material for extending the time interval during which impact occurs, thereby reducing the magnitude of the resultant impact force, and thereby also protecting the unitary assembly.

U.S. Pat. No. 3,903,827, which issued to Marcil on Sep. 9, 1975, describes a non-heeling hull assembly. A boat including a hull having a deck and bottom, a sail carrying mast, and a keel structure, with the mast and keel being pivotally supported from the hull and so operatively connected by hydraulic or mechanical means that when the boat is wind driven the mast may tilt to port or starboard with concurrent pivoting of the keel structure in an opposite direction. Pivoting of the mast and keel structure is independent of the hull, and the hull remaining in a non-heeling position when the boat is wind driven at a substantial rate is described.

U.S. Pat. No. 5,007,868, which issued to Fry on Apr. 16, 1991, describes a replaceable skeg for a marine propulsion device. It includes a tapered dovetail tongue and groove joint between the top of the skeg and lower portion of a gear case housing on the marine propulsion device. When the skeg is hit by an underwater obstruction it will fracture at the joint and break away, leaving the lower portion of the gear case housing in tact and undamaged in which another skeg can be installed thereto.

U.S. Pat. No. 5,018,997, which issued to Guptill on May 28, 1991, describes a skeg protector. It is mounted on the leading edge of the skeg of a boat motor. The protector is in the form of a channel of stainless steel fitted on the skeg with the base of the channel spaced forwardly of the leading edge of the skeg. A rubber strip extends along the inside of the channel.

U.S. Pat. No. 5,277,632, which issued to Davis on Jan. 11, 1994, describes a boat motor replacement skeg. It is thin and flat and has a cavity formed in one of its edges. The replacement skeg is slid over the stub which remains after the original skeg is broken off and is fastened to the skeg stub with silicon sealant and rivets.

U.S. Pat. No. 5,361,715, which issued to Kiedaisch et al. on Nov. 8, 1994, describes a marine dock fender contact surface attaching boss. The fender for absorbing the impact between converging bodies includes a supporting surface, a plurality of bosses and an energy absorbing member. The plurality of bosses protrudes from the supporting surface at spaced locations. Each boss has an outer perimeter. The energy absorbing member surrounds the outer perimeter of each boss so that each boss absorbs vertical and horizontal shear forces within the energy absorbing member.

U.S. Pat. No. 6,315,623, which issued to Hedlund on Nov. 13, 2001, describes a drive means in a boat. The drive assembly includes a propeller shaft housing which projects downwards on the underside of the bottom of the boat and is connected to a drive unit, arranged on the side of the boat, via members which, in the event of a load acting on the housing, for example in the event of grounding, bring about controlled separation of the housing from the drive unit and the bottom of the boat.

U.S. Pat. No. 6,966,806, which issued to Bruestle et al. on Nov. 22, 2005, discloses a replaceable leading edge for a marine drive unit. A marine propulsion device is made of first and second portions which are removably attachable to each other. The second portion is the leading edge portion of the nose cone and the driveshaft housing. It can also comprise a portion of the skeg. The second portion is configured to crush more easily in response to an impact force than the first portion. This can be accomplished by making the second portion from a different material than the first portion, which can be aluminum, or by providing one or more crush boxes within the structure of the second portion to cause it to yield more quickly to impact force and thus protect the first portion which is the more critical structure of the marine device.

U.S. Pat. No. 7,435,147, which issued to Eichinger on Oct. 14, 2008, discloses a breakaway skeg for a marine propulsion device. The device is provided with a breakaway skeg having first and second attachment points. The first and second attachment points are configured to result in the second attachment points disengaging from a gear case or housing structure prior to the first attachment point. The attachment points can comprise open or closed slots and, when an open slot is used for the first attachment point, it can be provided with a first edge along which a first pin can exert a force along a preselected angle in response to an impact force on the skeg. The arrangement of attachment points allows a reaction force at the second pin to be predetermined in a way that assures the detachment of the skeg from the housing structure prior to the detachment of the housing structure from another structure, such as the boat hull, or transom.

U.S. patent application Ser. No. 11/970,132 (M10158), which was filed by Mihelich et al. on Jan. 7, 2008, discloses a marine drive with a breakaway mount. A marine drive has a breakaway mount mounting first and second sections of the drive and breaking away in response to a given underwater impact against the second section to protect the first section and the vessel. It is particularly intended for use in conjunction with marine propulsion devices that extend downwardly, with a generally vertical driveshaft, through the hull of a marine vessel.

U.S. patent application Ser. No. 11/970,141 (M10164), which was filed by Eichinger on Jan. 7, 2008, discloses a torsion bearing breakaway mount for a marine drive. A marine drive has a breakaway mount provided by hollowed out threaded fasteners mounting first and second sections of the drive and breaking away in response to a given underwater impact against the second section to protect the first section and the vessel. The threaded fasteners are arranged in a bolt circle and positioned in a way that allows a marine drive unit to be cleanly separated from the marine vessel without adversely affecting the integrity of the marine vessel. It is particularly intended for use in marine propulsion systems that incorporate a generally vertical driveshaft extending downwardly through the hull of the marine vessel, but can be used in other types of drive units.

The patents described above are hereby expressly incorporated by reference in the description of the present invention.

As described above, many different types of energy absorbing devices and systems are known for use in conjunction with marine vessels. However, as will be described in greater detail below, the known types of devices typically exhibit disadvantages in their use. For example, although certain types of resilient bumpers can be applied to the leading edges of marine drive units to absorb energy, they are limited in the maximum amount of energy that can be withstood before complete destruction of a marine drive unit occurs in a way that can sink the marine vessel. Other devices are configured to cleanly break away from a marine vessel to avoid catastrophic damage to the vessel in the event of an impact at relatively high speeds. However, if devices of this type experience a relatively low energy collision with underwater obstructions, a premature breaking away of the drive unit can be unnecessarily expensive. Another concern that exists when employing energy absorbing devices is the effect on passengers of the marine vessel during the brief time when the energy is being absorbed by the device. Any device that involves the sudden deceleration of a moving marine vessel can also cause the passengers of the vessel to be adversely affected since, in most cases, those passengers do not wear safety harnesses while traveling on the marine vessel. Therefore, unlike land vehicles, the passengers are not equipped with devices that stop their forward movement in the event that the marine vessel is suddenly decelerated.

It would therefore be significantly beneficial if a marine vessel could be provided with a system that addresses the various problems that occur when a marine vessel experiences an impact against a stationary obstruction at various different speeds.

SUMMARY OF THE INVENTION

A marine propulsion system, made in accordance with preferred embodiments of the present invention, comprises an engine disposed within a hull of a marine vessel, a housing structure having a deformable portion configured to absorb a first magnitude of energy in response to an impact with an object that is at least partially submerged, the housing structure being supported by a marine vessel at a frangible interface which is configured to separate at least partially from the marine vessel in response to the impact exceeding a second preselected magnitude of energy, a driveshaft, and a propeller shaft supported by the housing structure. The second magnitude of energy is greater than the first magnitude of energy and the driveshaft is connected in torque transmitting relation between the engine and the propeller shaft.

In particularly preferred embodiments of the present invention, the deformable portion is configured to be compressed from an initial dimension to a final dimension. The deformable portion can be configured to be resiliently compressed from the initial dimension to the final dimension and can be disposed at a leading edge of the housing structure. The driveshaft, in a preferred embodiment of the present invention, extends downwardly through the hull and into the housing structure which is disposed under, or beneath, the marine vessel. The frangible interface can comprise a plurality of shear studs.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
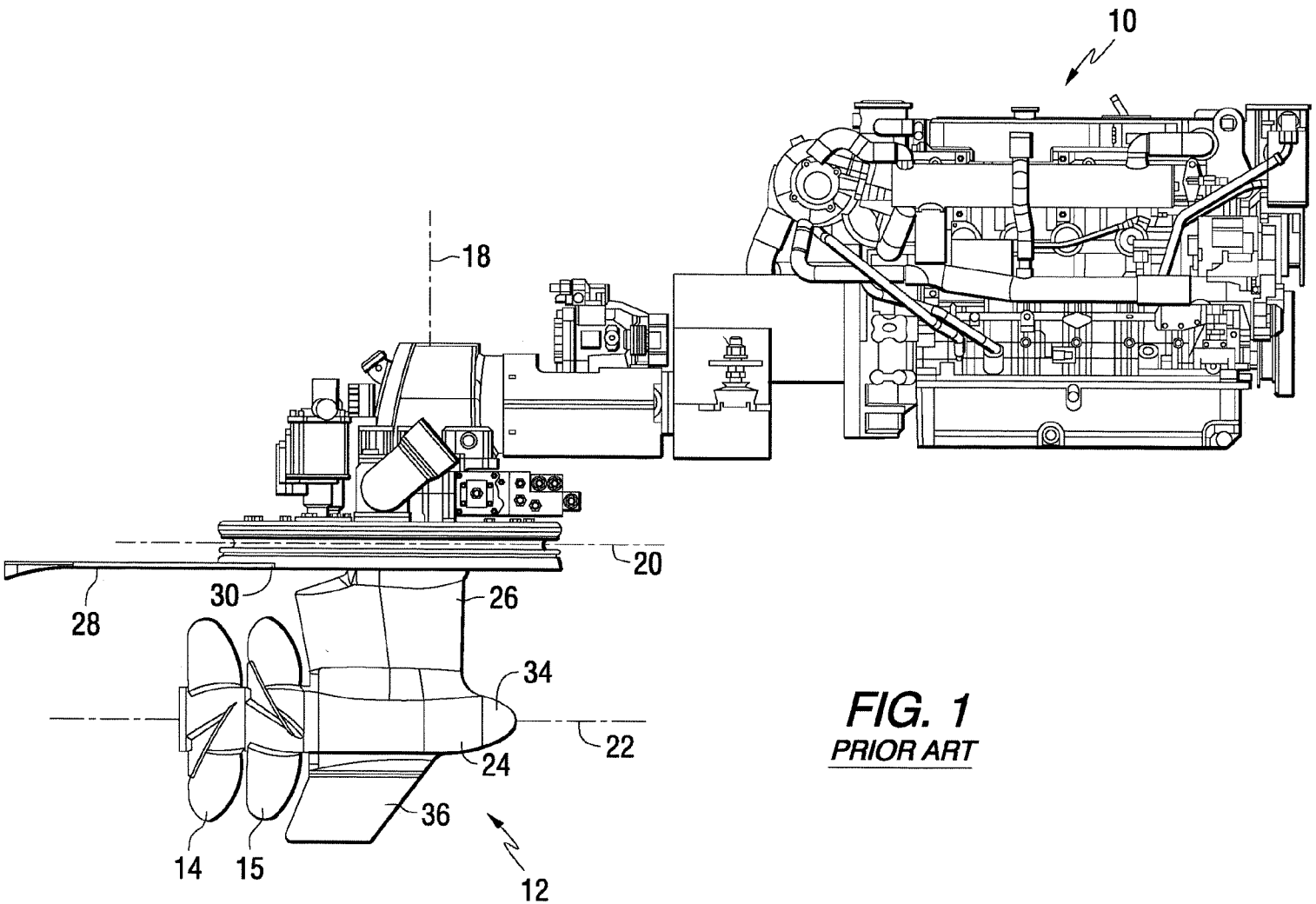
FIG. 1 PRIOR ART
FIG. 1 shows a known configuration of an engine and marine propulsion drive unit which is supported with its driveshaft extending downwardly and generally vertically through the hull of the marine vessel.

Throughout the description of the preferred embodiments of the present invention, like components will be identified by like reference numerals.

FIG. 1 illustrates a marine propulsion system which is generally known to those skilled in the art. It comprises an internal combustion engine 10 and a marine propulsion device 12 which are connected together in torque transmitting association to cause the rotation of the propellers, 14 and 15. The exemplary type of marine propulsion system shown in FIG. 1 comprises a driveshaft (not visible in FIG. 1) that is supported for rotation about a generally vertical axis 18 that extends downwardly through the hull of a marine vessel. Horizontal fine 20 represents the approximate position of the hull of the marine vessel, with water being disposed in contact with the lower surface of the hull below line 20 and the engine 10 and associated equipment being located above line 20 and in the bilge of the marine vessel. The components illustrated in FIG. 1, and connected between the engine 10 and the marine propulsion device 12, are used to control the steering of the drive unit, the flow of exhaust gas through the system, the hydraulic actuation system, and the other functions associated with the marine propulsion system. It should be understood, however, that the particular configuration and structure of the components shown above line 20 in FIG. 1 are not directly related to the preferred embodiments of the present invention and will not be described in specific detail herein.

With continued reference to FIG. 1, the propellers, 14 and 15, are attached to a propeller shaft which is supported for rotation about a generally horizontal propeller axis 22 by a gear case 24. The propeller shaft (not shown in FIG. 1) is connected in torque transmitting association with the driveshaft which is supported for rotation about generally vertical axis 18. A driveshaft housing 26 supports the driveshaft and gears that connect it to the propeller shaft. A trim tab 28 is shown attached to the propulsion device 12 and pivoted about a generally horizontal axis located at the position identified by reference numeral 30 in FIG. 1.

In pending patent application Ser. No. 11/970,132 (Mihelich et al.) and Ser. No. 11/970,141 (Eichinger), two breakaway systems are described in detail. Those systems result in a separation of the propulsion drive unit 12 from the hull of a marine vessel proximate the region identified by horizontal line 20 in FIG. 1. The breakaway function is accomplished through the use of shear bolts that are identified by reference numeral 306 and described in detail in those pending applications. Twelve shear bolts are arranged in a bolt circle that is shown in FIGS. 17-20 of those applications. Although the present invention is not limited to the precise arrangement described in the Mihelich et al. and Eichinger patent applications, those systems satisfactorily serve the purpose of providing the frangible interface of the present invention. An advantage of the systems described in those incorporated patent applications is that they allow the propulsion drive unit 12 to be separated from the hull without adversely affecting the integrity of the hull which could otherwise allow for leakage of water into the marine vessel if the propulsion drive unit 12 strikes a submerged object at a sufficient velocity. Although this type of impact is to be avoided if at all possible, systems such as those described in the incorporated patent applications identified above avoid the significantly deleterious result of a leaking hull in the event of such a collision between the drive unit 12 and a submerged obstruction, such as a reef or other submerged structure.

With reference to FIG. 1, the marine propulsion drive unit 12 has a nose cone 34 at the front portion of its gear case 24. The nose cone 34 can be made of an impact absorbing structure similar to that described in U.S. Pat. No. 3,151,597 which is discussed above. U.S. Pat. No. 6,996,806, which is also discussed above, provides a replaceable leading edge for both the nose cone and the front portion of the driveshaft housing 26. U.S. Pat. No. 7,435,147, also discussed above, describes a skeg, such as that illustrated in FIG. 1 and identified by reference numeral 36, which is configured to separate from the driveshaft housing 26 if it strikes a submerged obstruction. These structures, which are described in the prior art and discussed above, allow the submerged propulsion drive unit 12 to absorb energy upon impact with a submerged object without necessarily allowing the propulsion drive unit 12 to be damaged beyond repair or separated from the marine vessel.

When a submerged propulsion drive unit of a marine vessel strikes a submerged object, the effect of the impact depends on several parameters. Two of these parameters are the speed of the vessel when the impact occurs and the mass of the marine vessel. Naturally, more damage can be expected when the marine vessel is traveling at higher speeds than at relatively lower speeds. Also, significant damage can be expected even at relatively low velocities if the mass of the marine vessel is large. For example, a 30,000 pound (932.43 slugs) yacht can be expected to cause more significant damage to its submerged propulsion drive unit than a 5,000 pound (155.40 slugs) boat traveling at the same speed. This is because of the significantly greater magnitude of kinetic energy that must be absorbed when the impact occurs. As a result, it is difficult to generalize the best combination of components to deal with collisions and minimize damage.

An important consideration to be faced when dealing with a potential collision between a marine vessel and a submerged object is the effect on passengers. Regardless of the technique used to absorb energy during an impact, the marine vessel will experience a decrease in velocity as the energy is absorbed. Since the passengers on the marine vessel are typically not restrained by seatbelts or harnesses, they will typically continue to move forward as the marine vessel is decelerating during the impact. This effect on passengers must therefore be considered when configuring any system that is intended to control the degree of damage done to the marine vessel when its marine propulsion unit strikes a submerged object.

The preferred embodiments of the present invention are configured to absorb a preselected first magnitude of energy in response to an impact with an object that is at least partially submerged. The housing structure of the drive unit is also provided with a frangible interface that is configured to separate at least partially from the marine vessel in response to the impact exceeding a second preselected magnitude of energy, wherein the second magnitude is greater than the first magnitude. In order to analyze the various reactions that can occur when the drive unit strikes a submerged obstruction, it is helpful to consider three potential results that can be caused by the impact. At very low velocities and with marine vessels of low mass, the damage can be expected to be minor and is described herein as resulting in dents and scratches. Although this type of damage to the drive unit might be noticeable, it is unlikely to require significant repair or replacement of components. The next level of damage occurs when intentionally sacrificial portions of the drive unit are damaged to the degree that requires repair. This damage typically involves the crushing or smashing of leading edge portions of the drive unit. These portions typically comprise the nose cone of the gear case and possibly the leading edges of the driveshaft housing and/or skeg. These portions of the drive unit are intentionally configured to sacrificially absorb energy by being crushed during the impact. The third, and most severe, level of damage that is expected to occur during the collision between the drive unit and a submerged obstruction is the separation of the drive unit from the marine vessel. The Mihelich et al. and Eichinger inventions (described above) are intended to provide the frangible interfaces that result in the separation of the drive unit from the marine vessel without causing sufficient degradation in the integrity of the marine vessel that would permit leaking and potential sinking of the marine vessel. However, this result includes the complete removal of the drive unit from the vessel.

In order to understand the benefits of the preferred embodiments of the present invention, it is helpful to understand the potential results that occur to marine vessels that are generally known to those skilled in the art and which do not include the preferred embodiments of the present invention. If a marine vessel is equipped with neither an energy absorbing crush portion nor a frangible interface, the submerged drive unit of the marine vessel must absorb all of the energy from the impact with the submerged obstruction. Depending on the velocity at impact and the mass of the marine vessel, the damage can easily result in the destruction of the drive unit beyond any possible future use and damage to the hull which could result in the sinking of the marine vessel. If the marine vessel is provided with a frangible interface, such as those described in the Mihelich et al. and Eichinger inventions described above, but with no energy absorbing crush portions, any impact energy beyond that which merely dents or scratches the drive unit will result in at least the partial separation of the drive unit from the marine vessel. This represents a severe result if the impact occurs at relatively low velocities, such as during docking procedures. If the marine vessel is provided with energy absorbing crush portions, but no frangible interface, the submerged drive unit will be able to absorb relatively minor impacts, but will result in excessive and debilitating damage if the velocity during impact exceeds that which the drive unit is able to absorb as it is crushed. The level of damage may be sufficient to result in sufficient degradation of the integrity of the hull to cause the vessel to sink. It is the intent of the preferred embodiments of the present invention to provide a beneficial combination of the energy absorbing crush portion of the drive unit and the frangible interface which can absorb a minor impact without causing separation of the drive unit from the marine vessel, but which is also capable of reacting to a high energy collision by detaching the drive unit from the vessel in order to prevent catastrophic damage to the marine vessel.

FIGS. 2-7 show various embodiments of the present invention which are intended to provide the energy absorbing crush zones that react to low speed impacts, such as during docking maneuvers. The embodiments shown in FIG. 2-7 provide different configurations of the nose cone of the drive unit which is identified by reference numeral 34 in FIG. 1.

Figure 3:
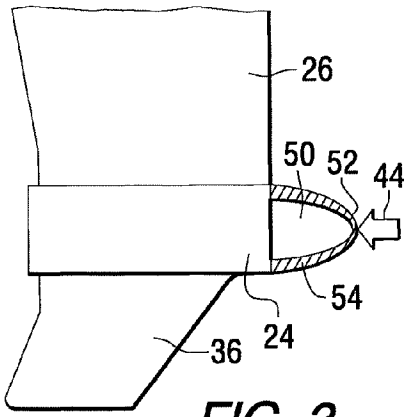
Figure 2:
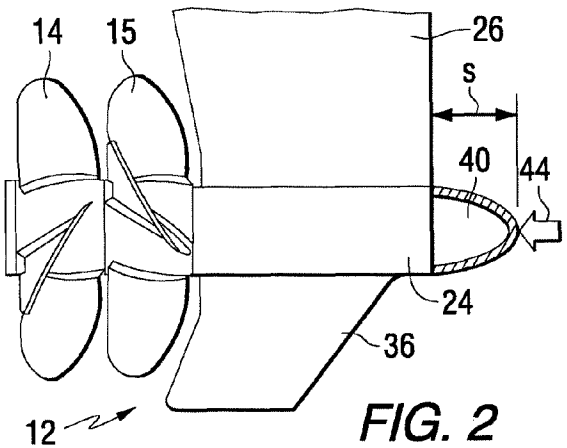

FIG. 2 shows a hollow nose cone 40 with a relatively thick wall that is configured to absorb energy by being crushed during impact with a submerged obstruction. Block arrow 44 is intended to represent the direction of force experienced by the nose cone 40 when the drive unit 12 strikes the obstruction. FIG. 3 shows a nose cone 50 which is thinner at the tip 52 than at the side walls 54. Again, arrow 44 illustrates the location and direction of the force against the nose cone resulting from a collision with a submerged object.

Figure 4:
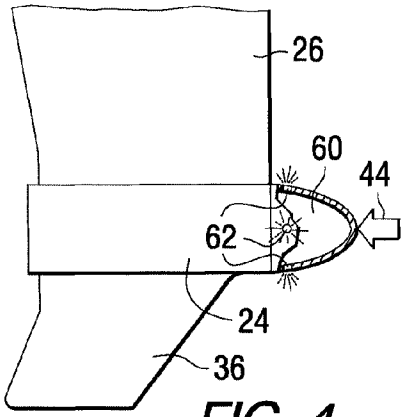
FIGS. 2-7 show various configurations of nose cones that can be used in various embodiments of the present invention.
Figure 5:
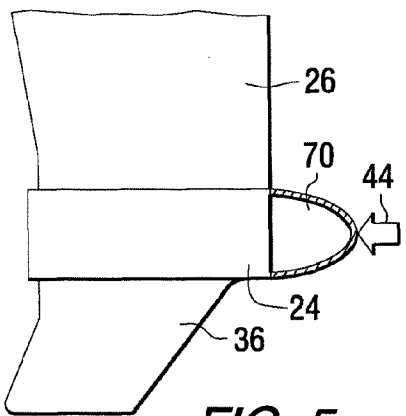

FIG. 4 illustrates a nose cone 60 that is hollow and is provided with several openings 62 that allow water to escape upon impact of the front tip of the nose cone with a submerged object. It is anticipated that during normal use the hollow portion of the nose cone 60 will fill with water as a result of its being submerged. The holes 62 are sized so that the water can normally drain out of the nose cone when the marine vessel is raised out of the water. However, during a sudden impact with a submerged object, the water contained within the hollow portion of the nose cone will be forced out of the opening 62 as the nose cone 60 is being crushed by the impact. This hydraulic effect will provide further energy absorption during the collision by resisting the immediate evacuation of the nose cone cavity. FIG. 5 shows a nose cone 70 which is generally similar to that described above in conjunction with FIG. 2, but with a thinner shell that is expected to collapse much more quickly upon impact with a submerged object.

Figure 6:
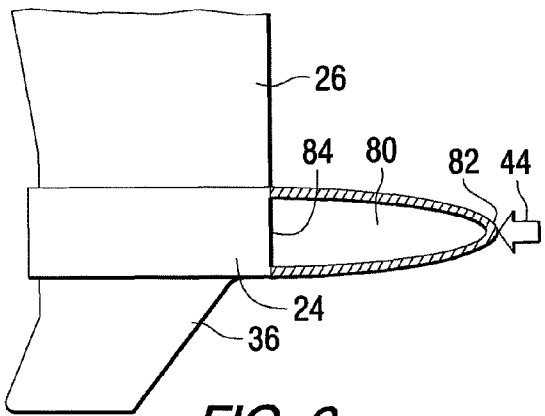

FIG. 6 illustrates a nose cone 80 with an elongated shape that is expected to absorb a significantly higher magnitude of energy than nose cones that are shorter in the dimension from its tip 82 to the gear case 84. The time duration of energy absorption, during the impact, is expected to be significantly longer than with shorter nose cones. As a result, the g forces experienced by passengers (on the marine vessel) are expected to be significantly lower as will be described in greater detail below.

Figure 7:
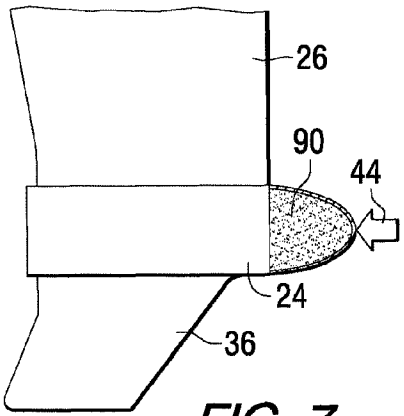

FIG. 7 shows a nose cone 90 that is filled with an energy absorbing foam that increases the magnitude of energy that can be absorbed during the crushing of the nose cone, relative to the magnitude of energy absorbed by a similar nose cone which is hollow. It should be understood that the filler within the nose cone can be made of various types of foam or aerogels such as that described above in U.S. Pat. No. 2,093,454 and subsequent developments provided by inventor Kistler and others. It should be understood that many different types of aerogels are known to those skilled in the art. Much work has been done in recent years to develop energy absorbing aerogels. These materials absorb kinetic energy by plastic deformation, elastic deformation, fracture, or by fluid dynamics of gases or liquids within the material. These materials for absorbing impacts are commonly organic foams, such as expanded polystyrene, polyurethanes, polyethers or polyethylene. They typically exhibit elastomeric or plastic behavior. It should be understood that the preferred embodiments of the present invention are not intended to provide new or inventive materials for absorbing energy. Instead, the preferred embodiments of the present invention incorporate materials that are otherwise available for the purpose of configuring the crushable portion of the drive unit in such a way that preselected magnitudes of energy can be absorbed during the crushing and deformation of the drive unit prior to the breaking of the frangible interface that would otherwise separate the drive unit from the marine vessel. During minor collisions, it is the intent of the present invention to avoid the drastic result of complete separation of the drive unit from the hull of the marine vessel that could otherwise occur if the crushable energy absorbing portion of the drive unit were not included.

Figure 8:
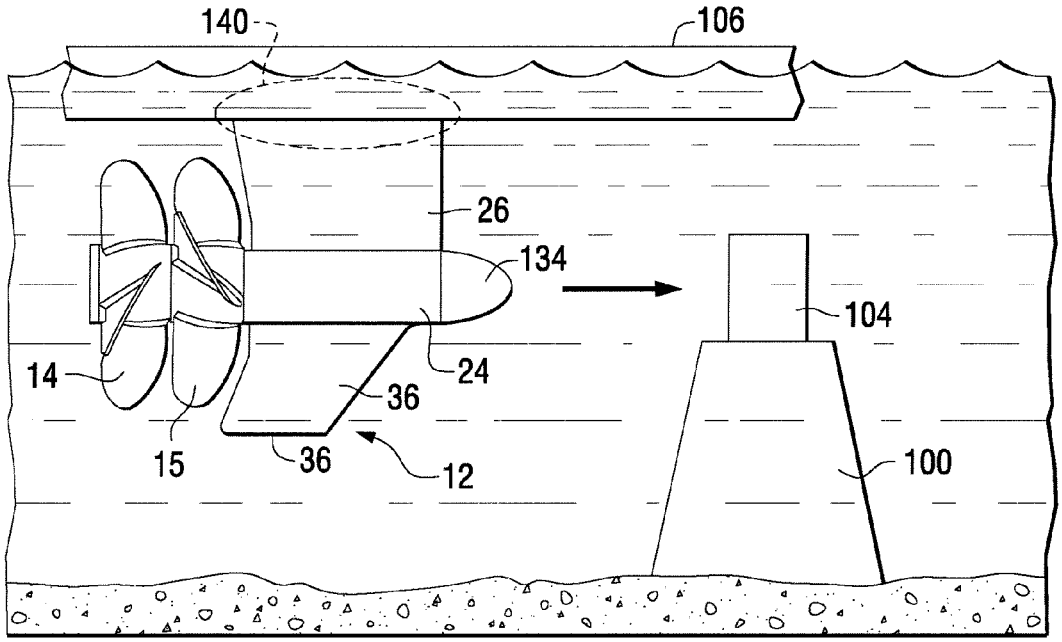
FIGS. 8 and 9 represent one type of incident where a nose cone of a drive unit is crushed during impact with a submerged object.
Figure 9:
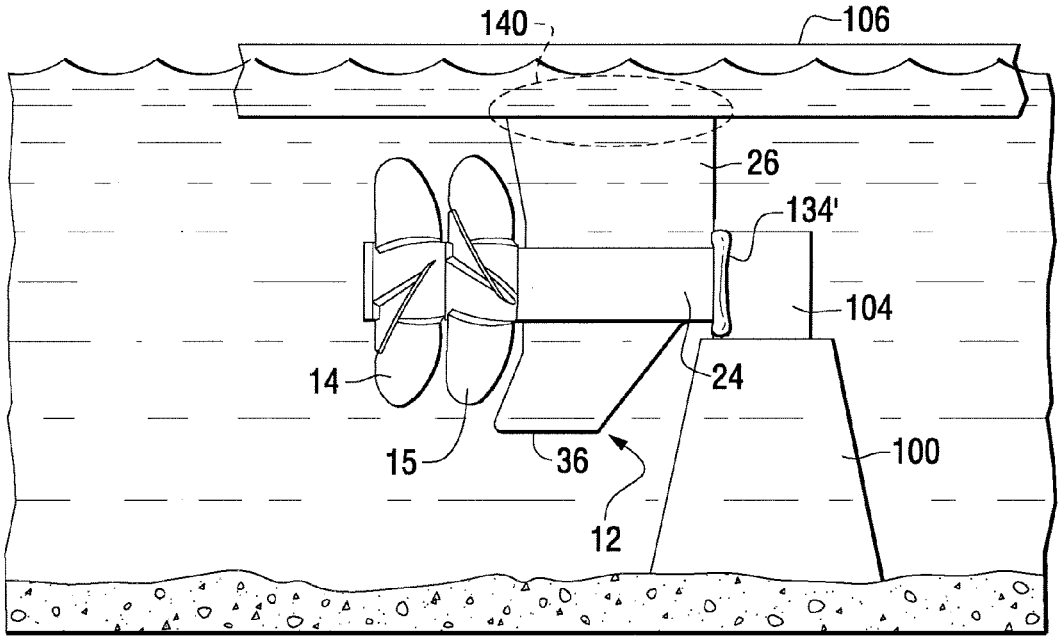

FIG. 8 illustrates the interaction of the propulsion drive unit 12 with a submerged obstruction which, in this example, is an abandoned portion of a former pier or dock that is represented as an exemplary concrete portion 100 with an upwardly directed extension portion 104 which can be wood or concrete. When the marine vessel is being maneuvered (e.g. for the purpose of docking), the drive unit 12 may move into contact with the submerged obstruction 104. The hull of the marine vessel is identified by reference numeral 106 in FIG. 8 and reference numeral 134 is used to identify the energy absorbing nose cone of the present invention. The marine vessel is moving in the direction of the arrow in FIG. 8. For this example, it is assumed that the operator of the marine vessel is unaware of the submerged obstruction 100 and 104 and that the marine vessel is moving at a relatively low velocity. The velocity and mass of the marine vessel will be discussed in greater detail below. FIG. 9 illustrates the crushed nose cone 134' subsequent to the impact with the submerged obstruction 104. It should be noted that the crushed nose cone 134' represents the only damage done to the propulsion drive unit 12. No separation has occurred between the drive unit 12 and the hull 106, such as at a frangible interface 140, because the velocity of the marine vessel and its mass were not sufficiently high to require more energy to be absorbed than was absorbed by the crushing of the nose cone 134'.

In FIGS. 8 and 9, the other components are identified by the reference numerals used above and will not be described again herein. The example represented in FIGS. 8 and 9 is intended to show that at low speeds, such as during docking maneuvers, all of the required energy can be absorbed by a crush portion of the drive unit, such as the crushable nose cone 134. It should also be understood that the nose cone 134 (and 134') in FIGS. 8 and 9, is intended to represent one or more of the various embodiments described above in conjunction with FIGS. 2-7.

Figure 10:
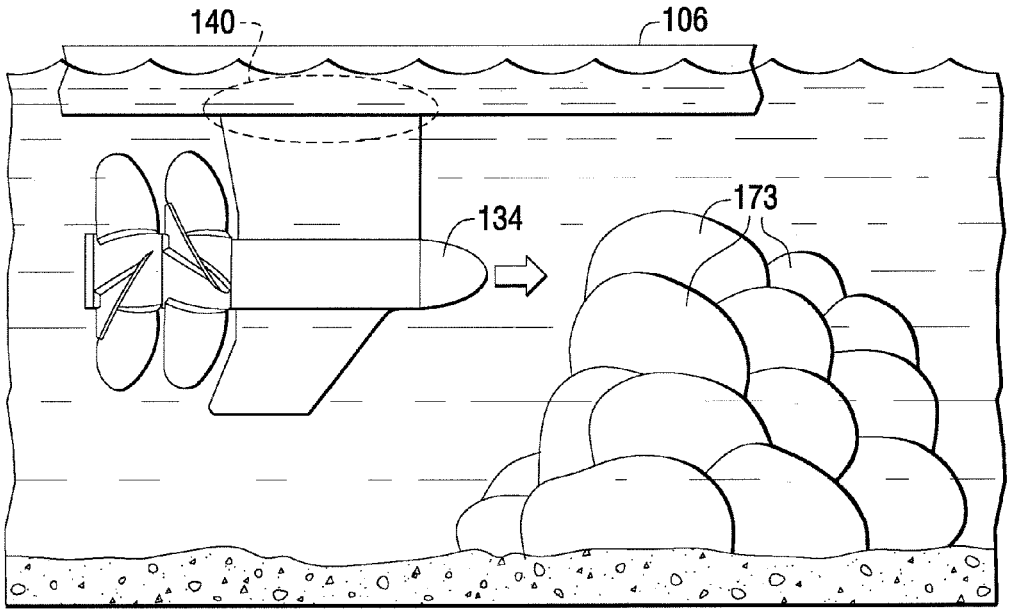
FIGS. 10 and 11 show a second type of incident where the drive unit of a marine vessel is detached from its hull as a result of an impact with a submerged object.
Figure 11:
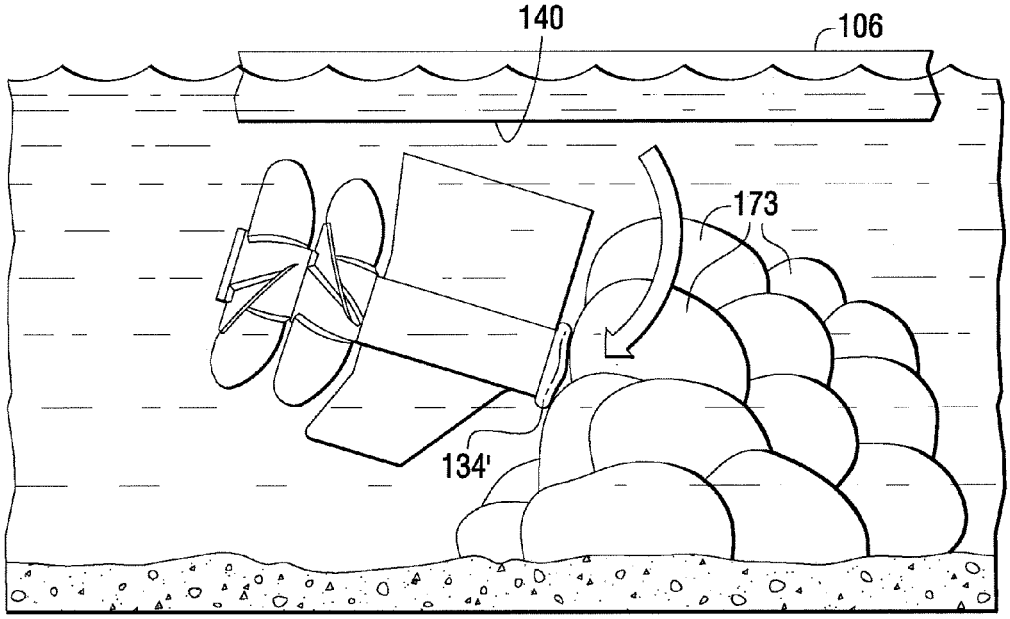

FIGS. 10 and 11 are generally similar to FIGS. 8 and 9, but are intended to represent an example where the marine vessel is traveling at a higher speed than would be typical for docking maneuvers. If the drive unit 12 strikes a submerged obstruction, such as a pile of rocks 173 shown in FIGS. 10 and 11, the damage to the drive unit could be greater than a mere crushing of the nose cone 134 as described above in conjunction with FIGS. 8 and 9. Instead, it could result in a complete separation of the drive unit 12 from the hull 106 as represented schematically in FIG. 11. It should also be noted that the nose cone 134 has been completely crushed as a result of its contact with the rocks 173, but that complete crushing of the nose cone 134' was not sufficient to absorb all of the energy resulting from the higher speed of the marine vessel. It should also be understood that the crushable nose cone 134 is not intended to alleviate the need for the frangible interface 140 and that the crushing of the nose cone 134' would be expected to occur in the very short period of time between the initial impact with the rocks 173 and the tearing loose of the drive unit 12 from the hull 106 of the marine vessel.

The first situation described above in conjunction with FIGS. 8 and 9 and the second situation described in conjunction with FIGS. 10 and 11 are considered herein to be completely independent occurrences with regard to the actions performed by the components of the preferred embodiments of the present invention, except for the very brief time immediately during the initial impact between the nose cone 134 and the rocks 173 and to the minor effect resulting from the small amount of energy absorbed by the crushable nose cone 134 immediately prior to the separation of the marine propulsion drive unit at the frangible interface 140. Although the effect of the crushable nose cone 134 in the second example associated with FIGS. 10 and 11 is not completely nonexistent, it is relatively insignificant and the provision of the crushable nose cone 134 is intended to fulfill a function generally unrelated to the higher velocity impact in the second example associated with FIGS. 10 and 11.

Figure 12:
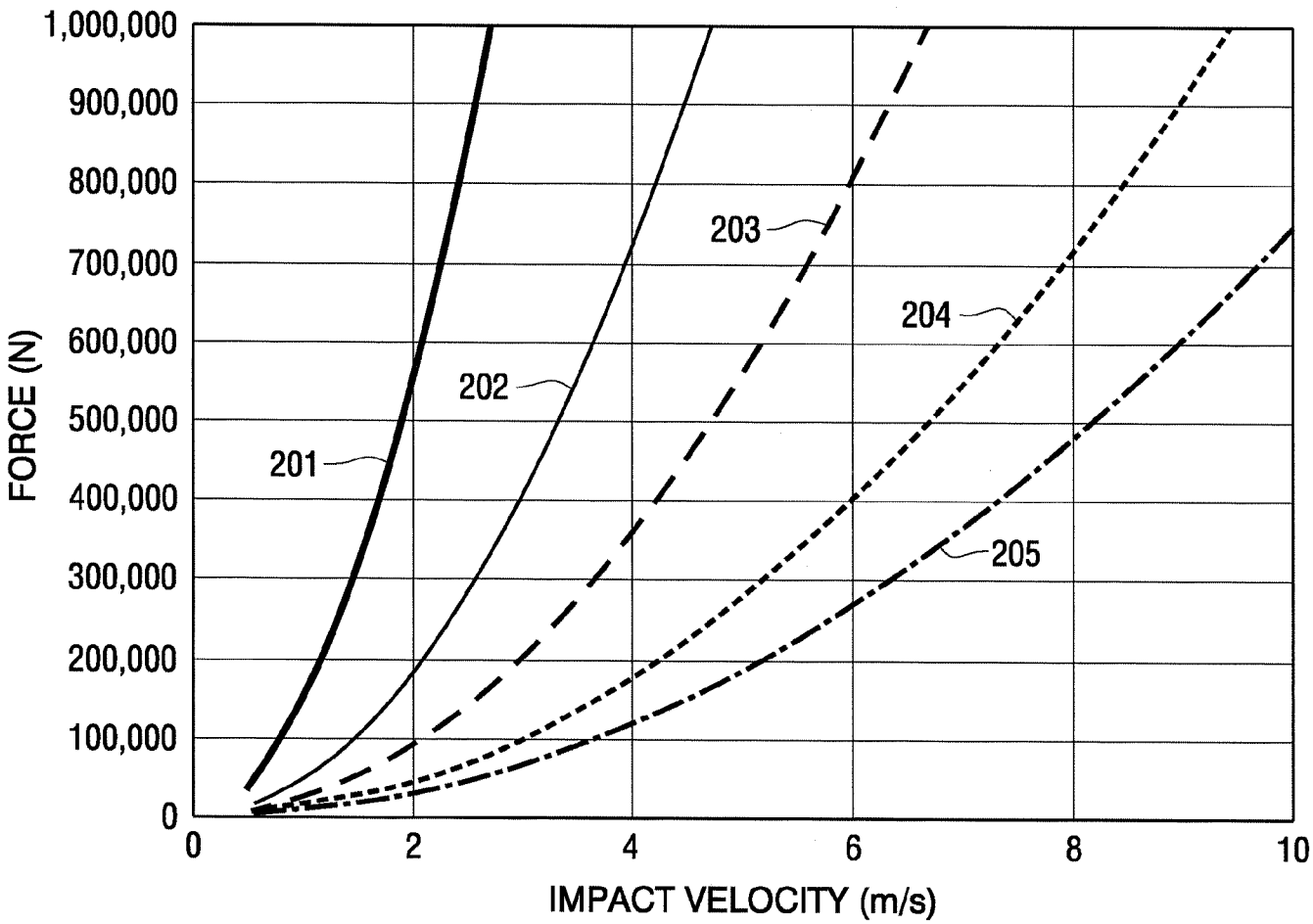
FIGS. 12-14 show graphical representations of various parameters associated with an impact of a drive unit with a submerged object and the resulting absorption of kinetic energy.

FIG. 12 is a graphical representation showing the resultant force caused by the deceleration of a 30,000 pound (13,608 kilograms) marine vessel within various stopping distances. For example, curve 201 shows the resulting force (in Newtons) on the marine vessel, and on the passengers of the marine vessel, when the 30,000 pound boat is stopped within a two inch distance after striking a submerged object. For purposes of these graphical representations, it is assumed that the submerged object is unmovable. As an example, the submerged object can be a dock or pier that is struck during docking maneuvers. Curves 202-205 represent the resulting forces at the various impact velocities when the marine vessel is stopped in 6 inches, 12 inches, 24 inches, and 36 inches, respectively. With reference to FIG. 12, this distance can be considered the crush length of the nose cone 40. In all of these examples shown in FIG. 12, it is assumed that the structure and composition of the nose cone is sufficient to stop the marine vessel in the distance defined between the tip of the nose cone to the point where the driveshaft housing 26 behind the nose cone moves into contact with the submerged obstruction. It should be understood that the graphical illustrations in FIGS. 12-14, as will be described below, are hypothetical and exemplary and are used for the purpose of showing the interrelationships between the variables, such as impact velocity, marine vessel mass, nose cone structure, and the distance s required to stop the marine vessel.

With continued reference to FIG. 12, it can be seen that a marine vessel weighing 30,000 pounds, which is equivalent to a mass of 13,608 kilograms, that is stopped within a distance of six inches from an initial velocity of 4 meters per second (8.95 miles per hour) results in a force on the marine vessel of slightly more than 700,000 Newtons as shown by line 202. If that same marine vessel is moving at only 2 meters per second (4.47 miles per hour), the force on the marine vessel is almost 100,000 Newtons when a 12 inch nose cone is used to stop the marine vessel before any damage is done to the driveshaft housing other than the crushed nose cone portion and if no separation is caused between the marine propulsion drive unit and the vessel hull. This is shown by line 203.

Figure 13:
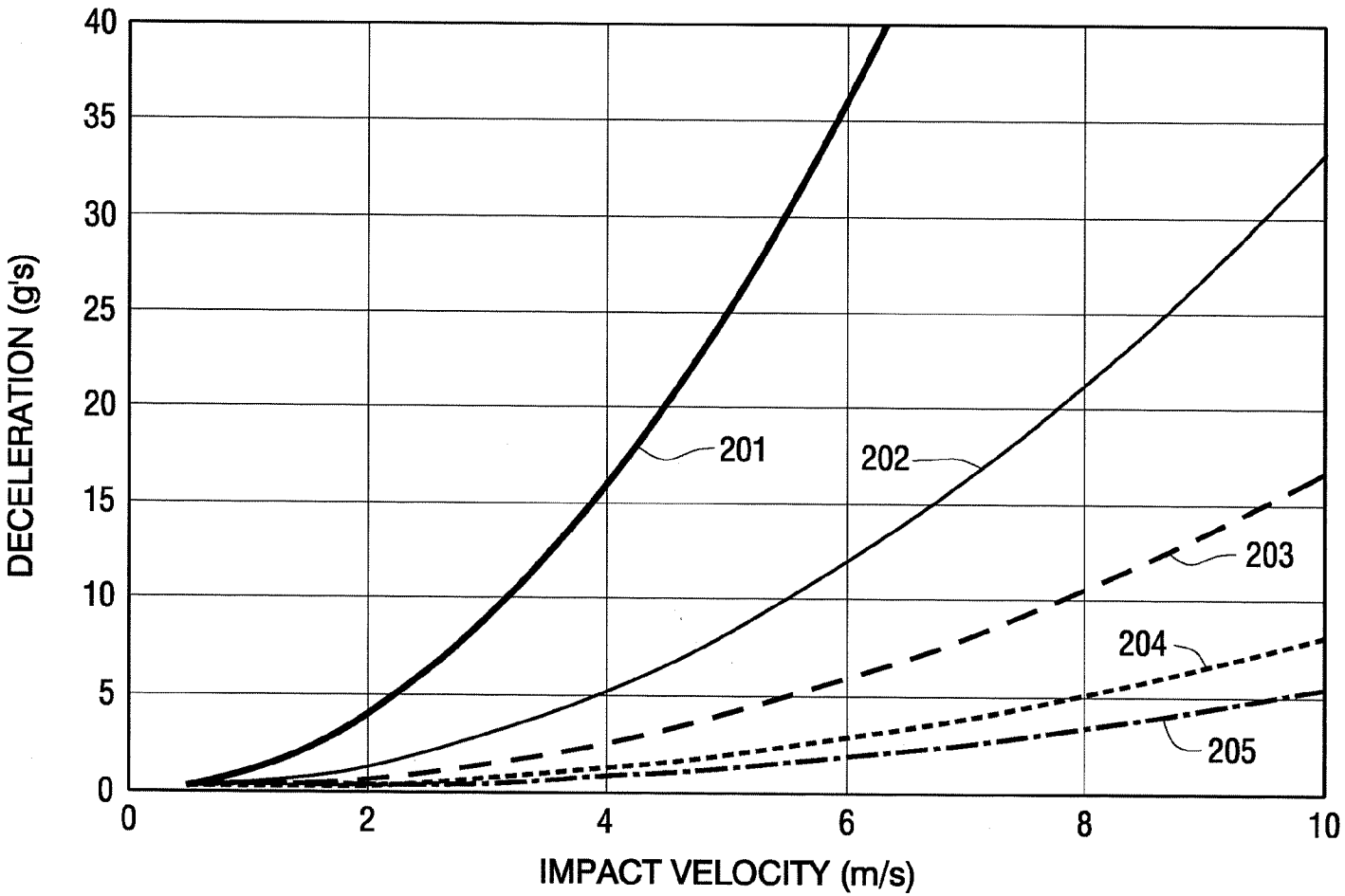
Figure 14:
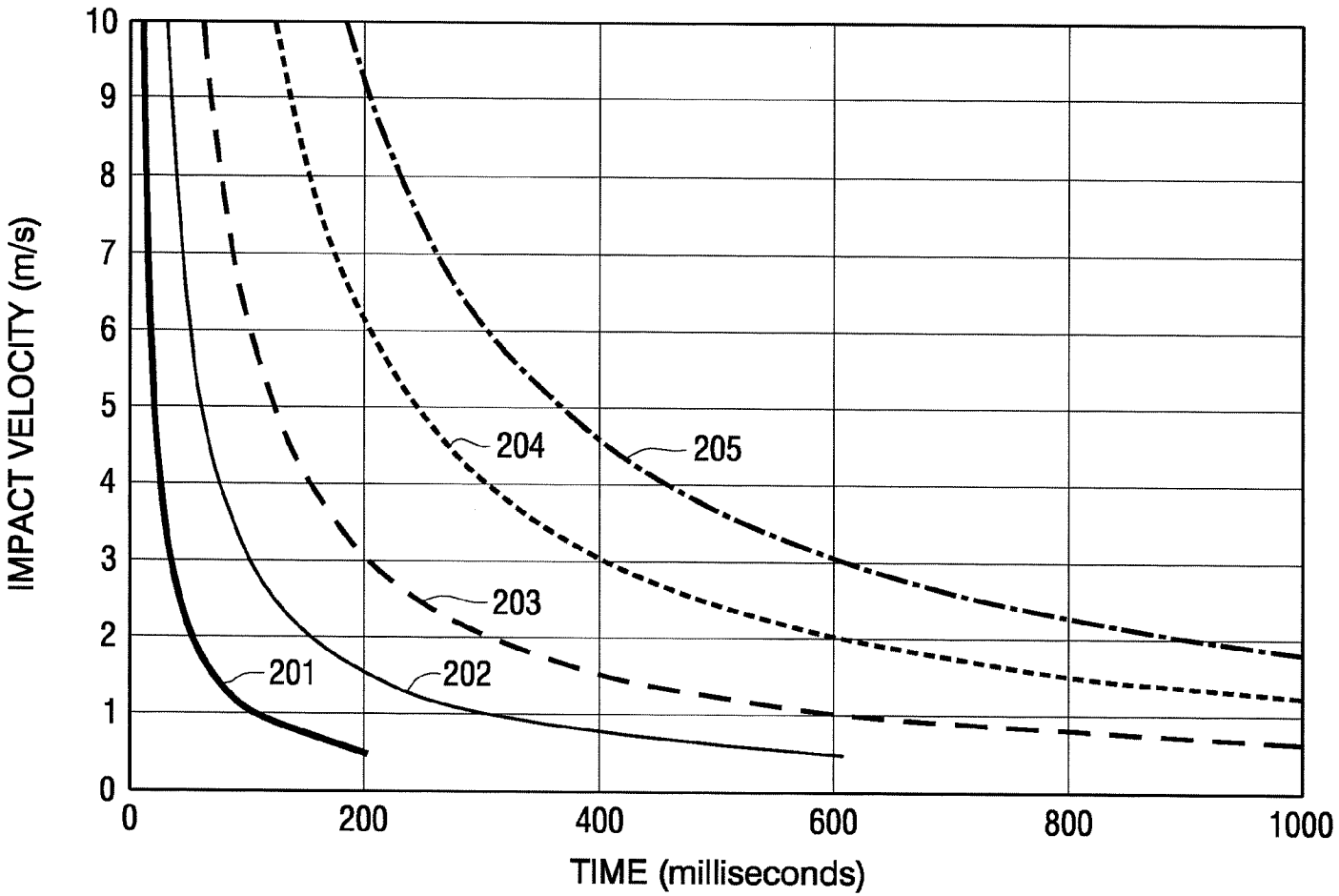

FIG. 13 is a graphical representation of the same marine vessel of 30,000 pounds (13,608 kilograms), but expressed in multiples of the acceleration of gravity g. As in FIG. 12, lines 201-205 are representative of the conditions associated with stopping distances of 2 inches, 6 inches, 12 inches, 24 inches, and 36 inches, respectively. FIG. 14 shows the relationship between the impact velocity, in meters per second, and the time that elapses during the crushing of the nose cone. Similarly to FIGS. 12 and 13, lines 201-205 are representative of the conditions associated with stopping distances of 2 inches, 6 inches, 12 inches, 24 inches, and 36 inches, respectively. This elapsed time, measured in milliseconds, is the time during which the marine vessel is decelerated from its initial velocity to a stationary condition subsequent to the impact and the crushing of the nose cone. As an example, if a 12 inch nose cone is crushed and effectively decelerates the vessel from an initial velocity of approximately 1.5 meters per second (3.36 miles per hour), it takes approximately 400 milliseconds to absorb the kinetic energy of the 30,000 pound marine vessel. The graphical representations shown in FIGS. 12-14 are intended to illustrate the significant effects involved during an impact when a marine vessel of moderate size strikes a stationary submerged object at relatively slow velocities. The energy involved in this type of impact is significant and, unless proper measures are taken, significant damage and bodily harm can occur. It should also be understood that, even at relatively low velocities that commonly exist during docking maneuvers, a marine vessel of 30,000 pounds can easily cause the detachment of the marine drive from the vessel hull, particularly when frangible interfaces are provided such as those described in the Mihelich et al. and Eichinger patent applications which are discussed above.

Frangible interfaces provide a valuable and important function by allowing the damage to the marine vessel to be controlled in such a way that the integrity of the hull is protected and the sinking of the marine vessel is avoided when a submerged object is struck by the marine propulsion drive unit. However, in order to be effective, a frangible interface such as those described in the patent applications discussed above, must be able to detach the drive unit from the hull at relatively low velocities. In other words, the drive unit must be configured in such a way that it is able to detach from the hull without causing forces during the deceleration of the marine vessel which can otherwise result in harm to passengers of the marine vessel. Therefore, even though a frangible interface can serve a valuable purpose in protecting the marine vessel from sinking as a result of an impact with a submerged object, the result can be very expensive if the drive unit is also caused to detach upon relatively minor impacts that can easily occur during docking maneuvers when the drive unit is inadvertently caused to strike some immovable portion of a pier or dock. It is therefore important that some additional means be provided to avoid the complete detachment of marine drive units when these accidental low speed impacts occur. However, when a relatively large marine vessel is being docked, the kinetic energy of the boat is often large enough, even at relatively low velocities, to result in the detachment of the drive unit to occur at the frangible interface.

Figure 15:
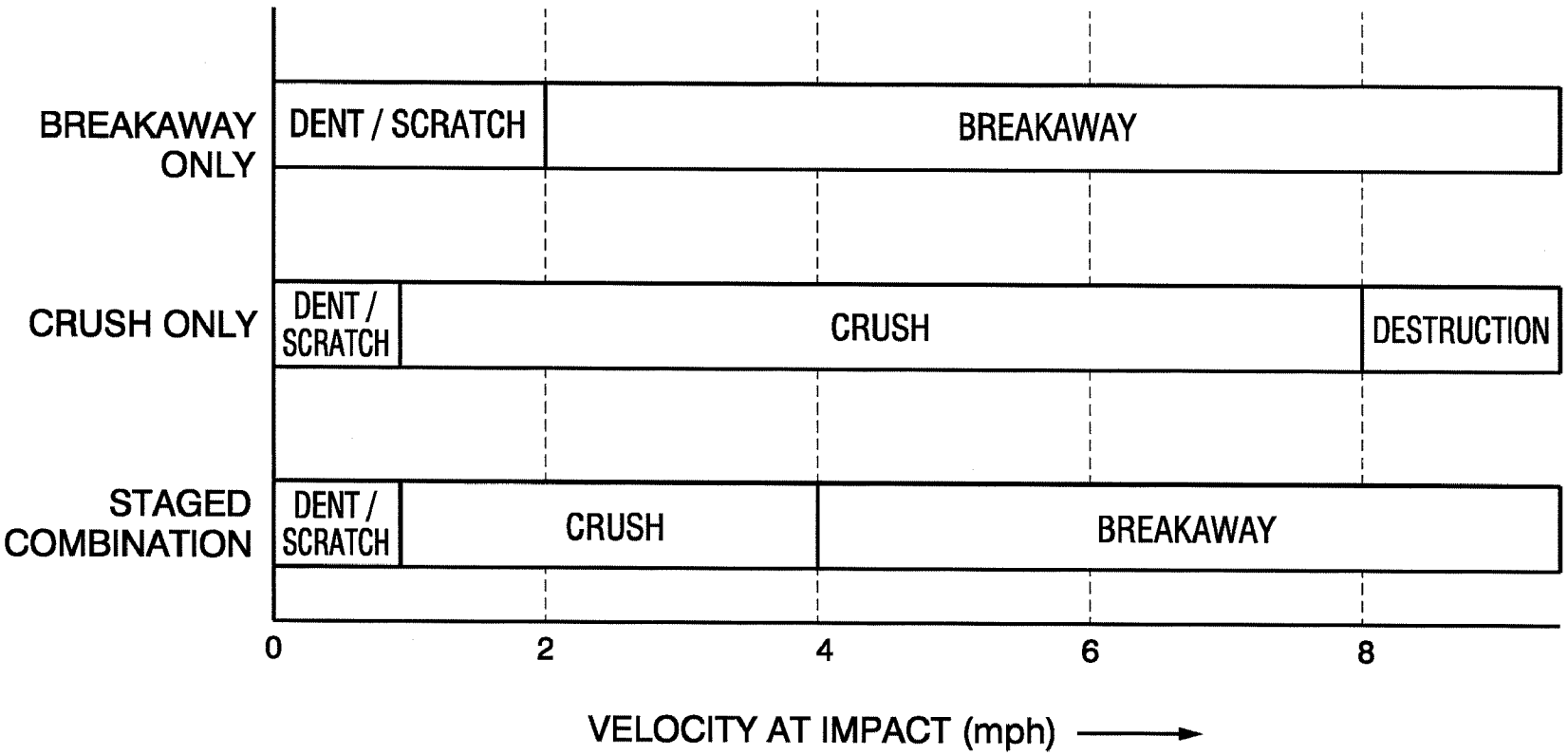
FIG. 15 is a graphical representation of various types of energy absorbing reactions by different combinations of energy absorbing devices.

FIG. 15 is intended to show the circumstances that must be addressed when designing energy absorbing portions of marine propulsion devices. It is also intended to show the dilemma faced by the designer when this design task is approached.

In FIG. 15, three examples are illustrated. In the horizontal bar shown at the top of FIG. 15, a situation is represented wherein the marine vessel is provided only with a frangible interface system such as those described in the Mihelich et al. and Eichinger patent applications. In the top horizontal bar of FIG. 15, it is assumed that no other device is provided to absorb energy in the event that the marine propulsion device impacts a submerged object. When only a breakaway system, or frangible interface system, is provided, the impacts at very low velocities would typically be expected to cause only minor dents and scratches. For the illustrated example, this is assumed to occur at impact velocities which are less than 2 miles per hour. This is equivalent to a speed of approximately 0.894 meters per second. For purposes of comparison, a jogger running at a relatively moderate speed travels at approximately 6.2 miles per hour. This is the speed of a jogger that could run a ten kilometer race in approximately 1 hour. A speed of 2 miles per hour, or 0.894 meters per second, is approximately one third of the speed of the moderate jogger used in this example. If a collision occurs when the operator of a marine vessel is maneuvering the vessel at a dock at 2 miles per hour or less, it is assumed that only dents or scratches will occur. However, if no other energy absorbing device is provided, in order to avoid subjecting passengers of the boat to forces that could otherwise result in their being knocked from their feet (in potential collisions at faster speeds), a breakaway system would typically have to be designed, and included, so that the drive unit would begin to separate from the hull of the marine vessel at speeds greater than 2 miles per hour. This could result in an expensive replacement, or reattachment, of the drive unit to the marine vessel hull as a result of an impact of this type. The top horizontal bar in FIG. 15 shows that at all velocities of impact greater than 2 miles per hour, the drive unit would breakaway from the hull.

With continued reference to FIG. 15, the second bar shows the type of design considerations that would probably be implemented if the marine propulsion drive unit is configured to have only a crushable nose cone and no breakaway or frangible interface system. Since it is assumed that the crushable nose cone is repairable, or replaceable, the device would probably be designed to begin to absorb energy at lower speeds than the breakaway-only system shown at the top of FIG. 15. For this example, it is assumed that the nose cone would be designed to begin absorbing energy, or being crushed, at an impact velocity of approximately 1 mile per hour. Within reasonable limits of size, the nose cone would cease to be practical at impact velocities of 8 miles per hour or greater. With reference to FIGS. 12-14, an impact velocity of 8 miles per hour is approximately equal to 3.576 meters per second. Even a nose cone that stops the marine vessel in 36 inches of travel after impact would result in approximately 100,000 Newtons of force on the marine vessel and its passengers. With reference to FIG. 12, a 6 inch nose cone would subject the marine vessel to approximately 550,000 Newtons under these circumstances. Therefore, it is believed that it is reasonable to assume that the crushable nose cone, if used as a sole energy absorbing device for the 30,000 pound marine vessel, would be practical between 1 mile per hour and 8 miles per hour. Above that speed, much more significant destruction would occur, resulting in a potentially significant breach of the hull integrity. The corresponding result, when the present invention is utilized, is illustrated in the bottom bar of FIG. 15. This is referred to as a staged combination which utilizes a crushable nose cone to absorb energy at impacts of relatively low velocities (e.g. less than 4 miles per hour) and only utilize the frangible interface (e.g. the inventions shown in the Mihelich et al. and Eichinger patent applications) when the collision occurs at speeds of 4 miles per hour or greater. In this way, expensive replacement or reattachment of the marine drive unit is not required when the collision occurs during docking maneuvers or at other impacts at less than 4 miles per hour.

It should be understood that the staged combination of energy absorbing devices provided by the preferred embodiments of the present invention is not intended to work in combination with each other during a single impact incident. In other words, even though the nose cone would be crushed immediately prior to the separation of the drive unit from the hull at higher impact speeds, that crushing of the nose cone is purely incidental and unavoidable, but is not intended to lessen the impact that occurs during the detachment of the drive unit from the marine vessel. Instead, the primary benefit of the staged combination provided by the preferred embodiments of the present invention is that the detachment is intentionally avoided at relatively low speeds.

More succinctly stated, the drive unit can be configured to result in the detachment at a higher speed than would otherwise be advisable. This can be seen by comparing the top and bottom horizontal bars in FIG. 15. When the crushed nose cone is not provided, the breakaway design must be designed to anticipate a separation at approximately 2 miles per hour or greater. This is not necessary with a staged combination of the present invention, as represented by the bottom horizontal bar in FIG. 15. The difference between the 2 miles per hour breakaway represented in the top bar and the 4 miles per hour breakaway represented by the bottom bar in FIG. 15 illustrates part of the benefit of the present invention. The crushable nose cone is provided so that it absorbs the necessary kinetic energy during low velocity impacts (e.g. during docking maneuvers) and the design of the breakaway, or frangible interface, system can be configured in a way that separates from the hull only at higher impact velocities, such as 4 miles per hour illustrated in the bottom bar of FIG. 15.

It should be clearly understood that sacrificial leading edges of marine drive units are generally known to those skilled in the art. U.S. Pat. No. 6,966,806 illustrates a device of this type. Also, U.S. Pat. No. 3,151,597 illustrates an energy absorbing nose cone for a marine drive unit. These types of nose cones, or other portions of leading edges, are known to those skilled in the art. Similarly, various breakaway devices are also known. U.S. Pat. No. 6,315,623 and U.S. Pat. No. 7,435,147 illustrate various frangible interfaces that serve these purposes. However, it should be clearly understood that the preferred embodiments of the present invention do not merely combine these two concepts. Instead, the crushable leading edge concept is used to allow a frangible intercept concept to be advantageously modified to be more effective than would otherwise be possible. This can be seen in FIG. 15 which shows the difference in the magnitudes of impact velocity that are possible with the staged combination illustrated in the bottom horizontal bar as compared to the system that only provides a breakaway device shown in the top bar. Similarly, the significant difference between the potential impact velocities of the staged combination and the crush only system is evident by comparing the middle and bottom horizontal bars in FIG. 15. Therefore, the staged combination of the present invention result in a uniquely different structure than either the breakaway only system or the crush only system. By employing the characteristics of the present invention, a marine propulsion system can be configured to satisfy the needs of docking maneuvers by absorbing the impact energies without the fear of causing a separation of the drive unit from the hull that would otherwise be possible. Similarly, the marine propulsion system can be provided with the frangible interface that protects the marine vessel and its passengers in the event that a collision occurs at higher velocities in circumstances that are represented in FIGS. 10 and 11. Perhaps the benefit of the present invention can best be understood by reviewing FIGS. 8-11 that show the circumstances under which the benefits of the staged combination can best be utilized.

At relatively low impact velocities, such as during docking procedures, a crushable nose cone is provided so that kinetic energy is absorbed to avoid more serious damage. This occurs, in the example shown in FIG. 15, at impact speeds of approximately 1 to 4 miles per hour. However, at collisions which occur at higher velocities, the separation of the drive unit occurs at speeds of approximately 4 miles per hour and greater. These two capabilities of the drive unit to absorb energy do not interfere with each other and are able to satisfy the needs of the marine vessel and its operator at a full range of potential impact velocities. Also, it should be understood that the benefits are not merely additive. The provision of the crushable nose allows the breakaway concept to be modified in order to increase its benefits. In addition, the provision of the breakaway feature allows the crushable nose cone to be configured in such a way that it is able to absorb the kinetic energy during impact at low velocities without the necessity of excessively large nose cones or extremely expensive materials. If the crushable feature is required to cover all of the speeds shown in the middle horizontal bar of FIG. 15, its size would be excessive and the materials used could be extremely expensive if the benefits are to be fully achieved.

A marine propulsion system made in accordance with the preferred embodiments of the present invention comprise an engine 10 disposed within a hull 106 of a marine vessel. The engine is disposed within the hull with its crankshaft supported for rotation about a generally horizontal axis. In FIG. 1, the crankshaft is not shown but those skilled in marine propulsion systems are well aware that the engine illustrated in FIG. 1 is supported in such a way that its crankshaft is horizontal, as in the typical use of an engine in land-based motor vehicles. This description of the engine 10 distinguishes it from the generally vertical crankshafts of engines used in outboard motors. In a preferred embodiment of the present invention, the propulsion system further comprises a housing structure 26 attached to the marine vessel and supported beneath the hull 106. The housing structure 26 has a deformable portion (e.g. the nose cone 40, 50, 60, 70, 80, or 90) configured to absorb a first magnitude of energy resulting from an impact with an object (e.g. 104) that is at least partially submerged. The deformable portion is configured to absorb the first magnitude of energy by being compressed from a first dimension to a second dimension (e.g. compare 134 and 134' in FIGS. 8 and 9). The deformable portion is a front surface of the housing structure 26 (e.g. the nose cone, skeg 36, or leading edge of the driveshaft housing 26). The housing structure is supported by the marine vessel at a frangible interface 140 (e.g. see Mihelich et al. or Eichinger patent applications) which is configured to separate at least partially from the marine vessel in response to the impact exceeding a second preselected magnitude of energy. The frangible interface can comprise a plurality of shear studs or other components which break upon impact. A preferred embodiment of the present invention can further comprise a propeller shaft supported by the housing structure 26 for rotation about a generally horizontal axis 22. In addition, a preferred embodiment of the present invention can further comprise a driveshaft supported by the housing structure 26 for rotation about a generally vertical axis 18. The driveshaft is connected in torque transmitting relation between the crankshaft and propeller shaft. The driveshaft extends downwardly through the hull. Although the driveshaft and propeller shaft are not shown specifically in the figures, those skilled in the art are very familiar with the location and appearance of these components and they are illustrated in detail and described in the Mihelich et al. and Eichinger patent applications discussed above. Alternatively, the deformable portion of the preferred embodiment of the present invention can be configured to be resiliently compressed from the first dimension to the second dimension instead of being crushed. This can be accomplished through the use of resilient materials or, alternatively, through the use of hydraulic components that return to an original shape and position subsequent to the impact. In certain embodiments of the present invention, the deformable portion can be configured to be destructively compressed, such as when certain metallic foams or honeycomb structures are used. The nose cone of the drive unit can be made of a foam material, such as an aerogel. Alternatively, the nose cone can be made of a material comprising a plurality of honeycomb cells.

Although the present invention has been described with particular detail and illustrated to show preferred embodiments, it should be understood that alternative embodiments are also within its scope.

We claim:

1. A marine propulsion system, comprising:

an engine disposed within a hull of a marine vessel;

a housing structure with a staged impact energy absorbing system having a deformable portion configured to absorb a first magnitude of energy in response to an impact with an object that is at least partially submerged, said housing structure being supported by said marine vessel at a frangible interface which is configured to separate at least partially from said marine vessel in response to said impact exceeding a second preselected magnitude of energy, said second magnitude of energy being greater than said first magnitude of energy;

a drive shaft; and a propeller shaft supported by said housing structure, said drive shaft being connected in torque transmitting relation between said engine and said propeller shaft;

wherein said first magnitude of energy is associated with said marine vessel traveling at a maximum velocity of four miles per hour and the deformable portion absorbs the first magnitude of energy without said frangible interface separating at least partially from said marine vessel and wherein said second magnitude of energy is associated with said marine vessel traveling at a velocity exceeding four miles per hour.

2. The system of claim 1, wherein:

said deformable portion is configured to be compressed from an initial dimension to a final dimension.

3. The system of claim 2, wherein:

said deformable portion is configured to be resiliently compressed from said initial dimension to said final dimension.

4. The system of claim 1, wherein:

said deformable portion is disposed at a leading surface of said housing structure.

5. The system of claim 1, wherein:

said drive shaft extends downwardly through said hull and into said housing structure which is disposed under said marine vessel.

6. The system of claim 1, wherein:

said frangible interface comprises a plurality of shear studs.

7. A marine propulsion system, comprising:

an engine disposed within a hull of a marine vessel, said engine having a crankshaft supported for rotation about a first generally horizontal axis;

a housing structure attached to said marine vessel and supported beneath said hull, said housing structure having a staged impact energy absorbing system with a deformable portion configured to absorb a first magnitude of energy resulting from an impact with an object that is at least partially submerged, said housing structure being supported by said marine vessel at a frangible interface which is configured to separate at least partially from said marine vessel in response to said impact exceeding a second preselected magnitude of energy;

a propeller shaft supported by said housing structure for rotation about a second generally horizontal axis; and a drive shaft supported by said housing structure for rotation about a generally vertical axis, said drive shaft being connected in torque transmitting relation between said crankshaft and said propeller shaft, said drive shaft extending downwardly through said hull;

wherein said first magnitude of energy is associated with said marine vessel traveling at a maximum velocity of four miles per hour and the deformable portion absorbs the first magnitude of energy without said frangible interface separating at least partially from said marine vessel and wherein said second magnitude of energy is associated with said marine vessel traveling at a velocity exceeding four miles per hour.

8. The system of claim 7, wherein:

said deformable portion is configured to absorb said first magnitude of energy by being compressed from a first dimension to a second dimension.

9. The system of claim 8, wherein:

said deformable portion is configured to be resiliently compressed from said first dimension to said second dimension.

10. The system of claim 7, wherein:

said deformable portion is configured to be destructively compressed from said first dimension to said second dimension.

11. The system of claim 7, wherein:

said deformable portion is a front surface of said housing structure; and said second magnitude of energy is greater than said first magnitude of energy.

12. The system of claim 1, wherein:

said frangible interface comprises a plurality of shear studs.

13. The system of claim 7, wherein:

said deformable portion comprises a nosecone made of foam material.

14. The system of claim 7, wherein:

said deformable portion comprises a nosecone made of a material comprising a plurality of honeycomb cells.

15. A marine propulsion system, comprising:

an engine disposed within a hull of a marine vessel, said engine having a crankshaft supported for rotation about a first generally horizontal axis;

a housing structure attached to said marine vessel and supported beneath said hull, said housing structure having a staged impact energy absorbing system with a deformable portion configured to absorb a first magnitude of energy resulting from an impact with an object that is at least partially submerged, said deformable portion being configured to absorb said first magnitude of energy by being compressed from a first dimension to a second dimension, said deformable portion being a front surface of said housing structure, said housing structure being supported by said marine vessel at a frangible interface which is configured to separate at least partially from said marine vessel in response to said impact exceeding a second preselected magnitude of energy, said frangible interface comprising a plurality of shear studs;

a propeller shaft supported by said housing structure for rotation about a second generally horizontal axis; and a drive shaft supported by said housing structure for rotation about a generally vertical axis, said drive shaft being connected in torque transmitting relation between said crankshaft and said propeller shaft, said drive shaft extending downwardly through said hull;

wherein said first magnitude of energy is associated with said marine vessel traveling at a maximum velocity of four miles per hour and the deformable portion absorbs the first magnitude of energy without said frangible interface separating at least partially from said marine vessel and wherein said second magnitude of energy is associated with said marine vessel traveling at a velocity exceeding four miles per hour.

16. The system of claim 15, wherein:

said deformable portion is configured to be resiliently compressed from said first dimension to said second dimension.

17. The system of claim 15, wherein:

said deformable portion is configured to be destructively compressed from said first dimension to said second dimension.

18. The system of claim 15, wherein:

said deformable portion comprises a nosecone made of foam material.

19. The system of claim 15, wherein:

said deformable portion comprises a nosecone made of a material comprising a plurality of honeycomb cells.

20. The system of claim 1, wherein said deformable portion is hollow with a plurality of openings enabling the deformable portion to fill with water when submerged, said water being forced through said openings and out of said deformable portion during said impact.

21. The system of claim 7, wherein said deformable portion is hollow with a plurality of openings enabling the deformable portion to fill with water when submerged, said water being forced through said openings and out of said deformable portion during said impact.

22. The system of claim 15, wherein said deformable portion is hollow with a plurality of openings enabling the deformable portion to fill with water when submerged, said water being forced through said openings and out of said deformable portion during said impact.

* * * * *